US007773924B2

(12) United States Patent
Ikeda

(10) Patent No.: US 7,773,924 B2
(45) Date of Patent: Aug. 10, 2010

(54) IMAGE FORMATION APPARATUS, AN IMAGE FORMATION METHOD, AND A COMPUTER-READABLE RECORDING MEDIUM

(75) Inventor: Hiroaki Ikeda, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 534 days.

(21) Appl. No.: 11/699,035

(22) Filed: Jan. 29, 2007

(65) Prior Publication Data

US 2007/0177912 A1 Aug. 2, 2007

(30) Foreign Application Priority Data

Jan. 30, 2006 (JP) ..... 2006-020946

(51) Int. Cl.
*G03G 15/01* (2006.01)

(52) U.S. Cl. ..... 399/301; 399/49; 347/116

(58) Field of Classification Search ..... 399/301–303, 399/38, 46, 49, 297, 298; 347/116, 229, 347/234, 248

See application file for complete search history.

(56) References Cited

U.S. PATENT DOCUMENTS 6,295,435 B1 * 9/2001 Shinohara et al. ..... 399/301
6,380,960 B1 * 4/2002 Shinohara ..... 347/116
6,693,654 B2 * 2/2004 Shinohara ..... 347/116
2005/0009351 A1 * 1/2005 Takahashi et al. ..... 438/689
2005/0031361 A1 * 2/2005 Kobayashi ..... 399/49

FOREIGN PATENT DOCUMENTS

JP 2002-244393 8/2002

* cited by examiner

*Primary Examiner*—David P Porta
*Assistant Examiner*—Milton Gonzalez
(74) *Attorney, Agent, or Firm*—Harness, Dickey & Pierce, P.L.C.

(57) ABSTRACT

An image formation apparatus is disclosed to form a color image for imprinting, and the color image for imprinting is imprinted to an imprinting medium. The image formation apparatus includes an image formation unit for forming plural sets of marks for position error compensation for compensating for a position error of the different colors, which position error is generated when forming the color image on the conveyance belt, a detection unit for detecting position information about positions of the sets of marks for position error compensation formed on the conveyance belt by the image formation unit, a control unit for performing a position error compensation process based on the position information detected by the detection unit, and a storage process of storing the position information of the sets of the marks for the position error compensation detected by the detection process.

9 Claims, 6 Drawing Sheets

IMAGE FORMATION APPARATUS, AN IMAGE FORMATION METHOD, AND A COMPUTER-READABLE RECORDING MEDIUM

BACKGROUND OF THE INVENTION

1. Field of the Invention

The present invention relates to an image formation apparatus for forming an image, an image formation method, an image formation program, and a computer-readable recording medium.

2. Description of the Related Art

A conventional method of compensating for the position error of the different colors is described below, which method is used by a color image formation apparatus wherein a color image for imprinting is formed by superposing toner images in two or more colors on an imprinting belt, and the color image for imprinting is imprinted onto an imprinting medium (paper).

The method includes processes of detecting an image for position error compensation formed on the imprinting belt, calculating a compensation value for compensating for the position error of the different colors based on a result of the detection, calculating a final compensation value based on the compensation value and a value input from an inputting unit, such as an operations panel, and compensating for the position error of each color based on the final compensation value when the color image is imprinted onto the imprinting medium (for example, Patent Reference 1).

[Patent reference 1] JPA 2002-244393

However, according to the conventional technique, the compensation value for compensating for the position error of each color cannot be calculated if the image for position error compensation has not been properly detected. For this reason, there is a problem in that a position error of a color may occur until the next detecting occasion. Further, if the image for position error compensation is formed and detection is performed again in order to properly perform the position error compensation for each color, there is a problem in that the time required of the position error compensation becomes long.

SUMMARY OF THE INVENTION

The present invention provides an image formation apparatus for forming an image, an image formation method, an image formation program, and a computer-readable recording medium that substantially obviate one or more of the problems caused by the limitations and disadvantages of the related art.

Features of embodiments of the present invention are set forth in the description that follows, and in part will become apparent from the description and the accompanying drawings, or may be learned by practice of the invention according to the teachings provided in the description. Problem solutions provided by an embodiment of the present invention may be realized and attained by an image formation apparatus for forming an image, an image formation method, an image formation program, and a computer-readable recording medium particularly pointed out in the specification in such full, clear, concise, and exact terms as to enable a person having ordinary skill in the art to practice the invention.

To achieve these solutions and in accordance with an aspect of the invention, as embodied and broadly described herein, an embodiment of the invention provides an image formation apparatus for forming an image, an image formation method, an image formation program, and a computer-readable recording medium that are capable of compensating for the position error of the different colors in a short time, which position error may be generated when forming an image, and performing a process of forming a highly precise image.

[Means for Solving a Subject]

The embodiment of the present invention provides an image formation apparatus, which image formation apparatus superposes two or more toner images in colors on an endless conveyance belt such that a color image for imprinting may be formed, and imprints the color image for imprinting onto an imprint medium. The image formation apparatus includes an image formation unit for forming two or more sets of marks for position error compensation on the conveyance belt for compensating for the position error of the different colors, the position error being generated when forming an image, a detection unit for detecting information about positions (position information) of the sets of the marks for position error compensation formed on the conveyance belt of the image formation unit, and a control unit for compensating for a position error based on the position information detected by the detection unit, wherein the control unit determines a number (first number) of detected positions of each of the sets based on the position information, and compensates for the position error based on the position information of the marks for position error compensation of a set, the number of the detected positions of which set is equal to a first predetermined number out of all the sets of the marks for position error compensation.

According to another aspect of the embodiment, the image formation apparatus includes a storage unit for storing the position information of the sets of the marks for position error compensation detected by the detection unit, wherein the control unit determines whether one or more of the sets do not have the first predetermined number of detected positions. Further, if the determination is affirmative (that is, if one or more of the sets do not have the first predetermined number of detected positions), the position information of the marks for position error compensation of a set, the number of detected positions of which sets is not equal to the first predetermined number, is excluded from the storage unit from all the position information of the sets of marks for position error compensation stored in the storage unit. Then, the position error compensation process is carried out based on the position information of the marks for position error compensation of the set, the number of detected positions of which set is equal to the first predetermined number.

According to another aspect of the present invention, if a second number of the sets of the marks for position error compensation, the first number of detected positions of which sets are different from the first predetermined number, is greater than a second predetermined number, the control unit changes a detection threshold value of the detection unit, and controls the image formation unit such that two or more sets of the marks for position error compensation are formed again for repeating the position error compensation process.

According to another aspect of the present invention, if the second number of the sets of the marks for position error compensation, the first number of detected positions of which sets is different from the first predetermined number, is greater than the second predetermined number, the control unit changes a detection threshold value of the detection unit, and controls the image formation unit such that two or more sets of the marks for position error compensation are formed again for repeating the position error compensation process, wherein the number of the sets of the marks for position error compensation is made less than the previous time (attempt).

According to another aspect of the present invention, the image formation apparatus includes two or more detection units for detecting the position information of two or more sets of the marks for position error compensation, compensation values for compensating for the position error are calculated for each set based on results of the detection, and the control unit performs the position error compensation process based on a compensation value that is obtained by averaging the compensation values.

The embodiment of the present invention provides the image formation method, wherein two or more toner images in different colors are superposed on a endless conveyance belt to form a color image for imprint, and the color image is imprinted onto an imprint medium, the image formation method including an image formation process of forming two or more sets of marks for position error compensation for compensating for the position error of the different colors generated when forming an image, which sets of marks are formed on the conveyance belt, a detection process of detecting position information about the positions of the sets of marks for position error compensation formed on the conveyance belt by the image formation process, and a control process of compensating for a position error based on the position information detected by the detection process, wherein the control process determines the number {a first number} of positions detected for each of the sets based on the position information, and compensates for the position error based on the position information of the marks for position error compensation of sets, the number of the positions detected of which set is equal to the first predetermined number out of all the sets of the marks for position error compensation.

According to another aspect of the present invention, the image formation method includes a storing process of storing the position information of the sets of marks for position error compensation detected by the detection process, wherein the control process determines whether one or more of the sets do not have the first predetermined number of detected positions. Further, if the determination is affirmative (that is, if one or more of the sets do not have the first predetermined number of detected positions), the position information of the marks for position error compensation of one or more sets, the first number of detected positions of which sets is not equal to the first predetermined number is excluded from all the position information. Then, the position error compensation process is carried out based on the position information of the marks for position error compensation of a set, the number of detected positions of which set is equal to the first predetermined number.

According to another aspect of the present invention, if the second number of the sets of the marks for position error compensation, the first number of the detected positions of which sets are different from the first predetermined number, is greater than the second predetermined number, the control process changes a detection threshold value of the detection process, and controls the image formation process such that two or more sets of the marks for position error compensation are formed again for repeating the position error compensation process.

According to another aspect of the present invention, if the second number of the sets of the marks for position error compensation, the first number of the detected positions of which sets is different from the first predetermined number, is greater than the second predetermined number, the control process changes a detection threshold value of the detection process, and controls the image formation process such that two or more sets of the marks for position error compensation are formed again for repeating the position error compensation process, wherein the number of the sets of the marks for position error compensation is made less than the previous time (attempt).

According to another aspect of the present invention, the detection process detects the position information of two or more sets of the marks for position error compensation, and the control process calculates compensation values for compensating for the position error for each set based on results of the detection, and performs the position error compensation process based on a compensation value that is obtained by averaging the compensation values.

Another aspect of the present invention provides an image formation program of making a computer perform the image formation method described above.

Another aspect of the present invention provides a computer-readable recording medium that stores the image formation program described above.

[Effectiveness of Invention]

According to the image formation apparatus, the image formation method, the image formation program, and the computer-readable recording medium of the present invention, a position error between the colors generated when forming an image can be compensated for in a short time, and a highly precise image formation process can be performed.

DESCRIPTION OF THE PREFERRED EMBODIMENTS

In the following, embodiments of the present invention are described with reference to the accompanying drawings.

Figure 1:
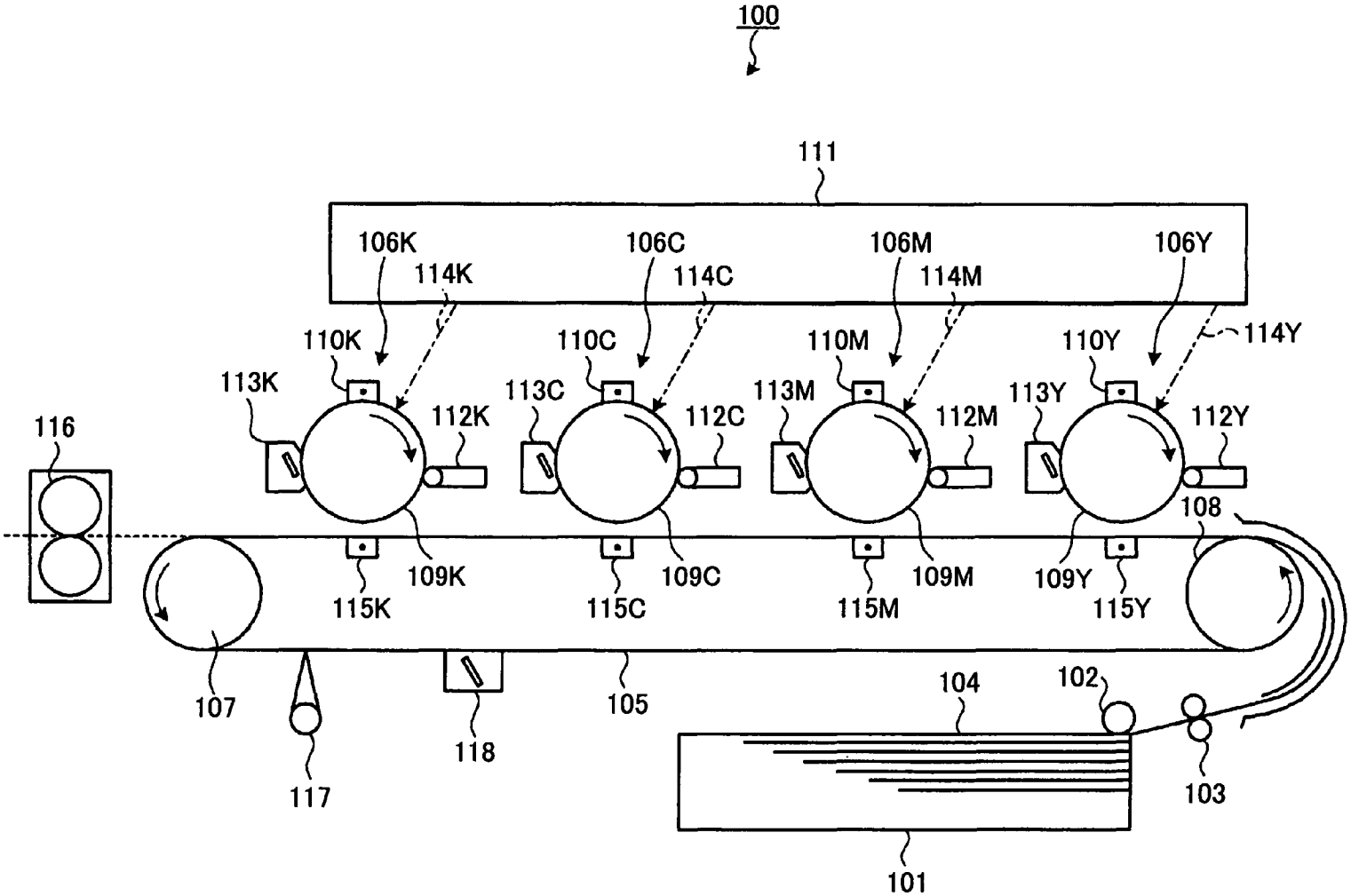
FIG. 1 is a schematic view of an image formation apparatus according to an embodiment of the present invention.
Figure 2:
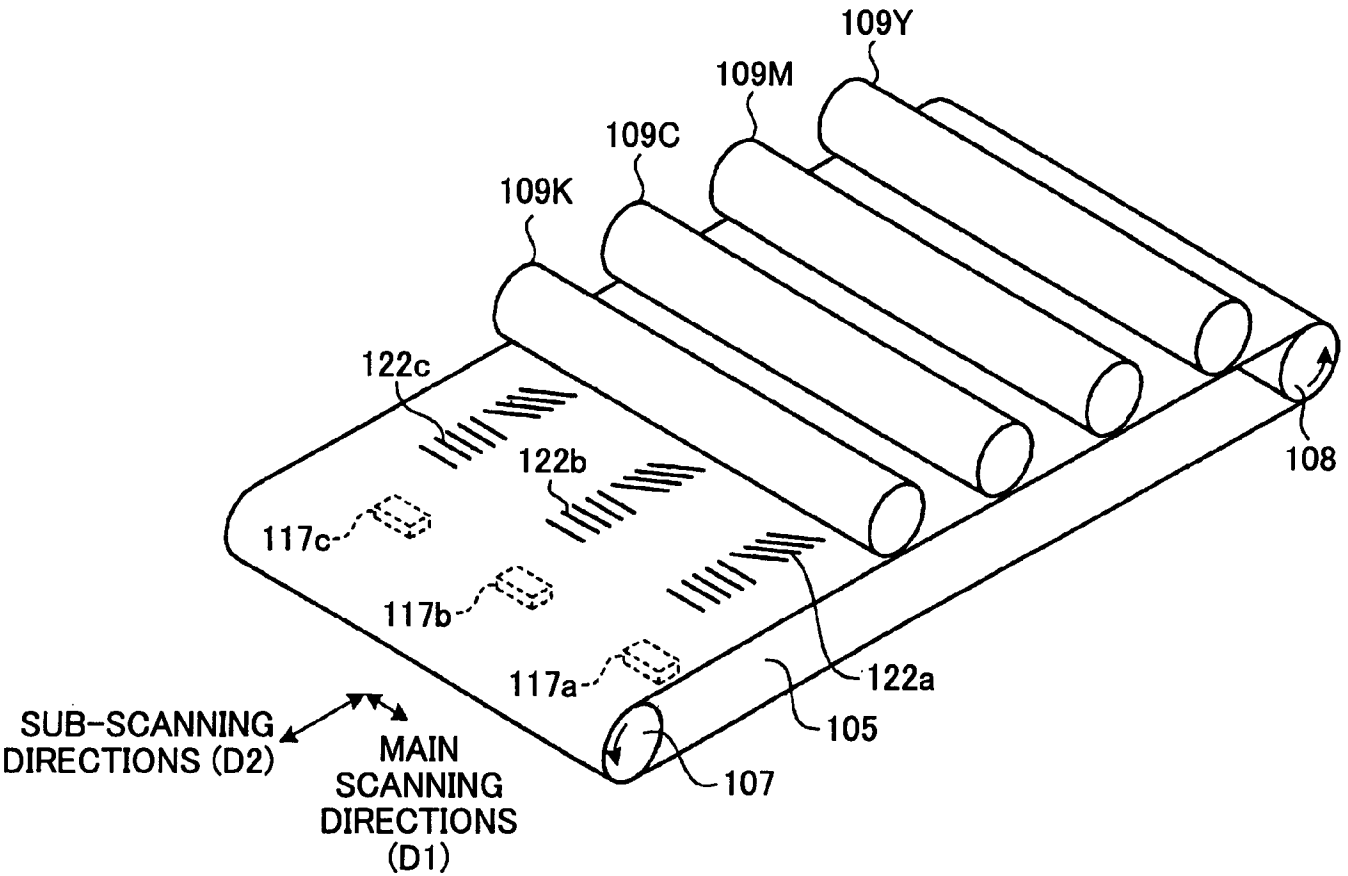
FIG. 2 is a perspective view showing a structure of a conveyance belt and the vicinity thereof of the image formation apparatus according to the embodiment of the present invention.

First, an image formation apparatus 100 according to the embodiment of the present invention is described with reference to FIGS. 1 and 2. FIG. 1 shows the outline of the image formation apparatus according to the embodiment of the present invention. FIG. 2 is a perspective view showing a conveyance belt and its vicinity of the image formation apparatus according to the embodiment of the present invention. The image formation apparatus 100 includes a paper feed tray 101, a feed roller 102, separation rollers 103, and recording media (paper) 104, a conveyance belt 105, image formation units 106 (K, C, M, and Y), a drive roller 107, a follower roller 108, photo conductor drums 109 (K, C, M, and Y), electrification units 110 (K, C, M, and Y), exposure units 111 (K, C, M, and Y), development units 112 (K, C, M, and Y), discharging units 113 (K, C, M, and Y), imprint units 115 (K, C, M, and Y), a fixing unit 116, a position error detection unit 117, and a cleaner 118.

The paper feed tray 101 is for storing sheets of the paper 104. The feed roller 102 is for feeding the paper 104 to the separation rollers 103 sheet by sheet from the top of the paper 104 that is stacked in the paper feed tray 101. The separation rollers 103 are for separating one sheet of paper 104 from the others so that only one sheet at a time is fed from the feed roller 102, and for conveying the sheet to a conveyance path. Then, the paper 104 is adhered to the conveyance belt 105 by electrostatic force, and is conveyed to the image formation units 106 according to timing so that a color image formed on the conveyance belt 105 is imprinted onto the paper 104.

The image formation units 106Y, 106M, 106C, and 106K may be collectively referred to as the image information units 106. The image formation units 106Y, 106M, 106C, and 106K have the same internal structure, with the only difference being color of a toner image that each of them forms. Specifically, the image formation unit 106Y forms an image in yellow, the image formation unit 106M forms an image in magenta, the image formation unit 106C forms an image in cyan, and the image formation unit 106K forms an image in black. In the following description, the image formation unit 106Y is described in detail, which description is also applicable to the image formation units 106M, 106C, and 106K, except for the color as described above. Components that constitute each of the image formation units 106M, 106C, and 106K are shown by replacing Y with the corresponding M, C, and K in the drawings.

The conveyance belt 105 that is made endless is wound around the drive roller 107 and the follower roller 108. The drive roller 107 is rotationally driven by a not-illustrated drive motor. The drive motor, the drive roller 107, and the follower roller 108 function as a drive unit for driving the conveyance belt 105.

The image formation unit 106Y includes the photo conductor drum 109Y, the electrification unit 110Y, the exposure unit 111, the development unit 112Y, and the discharging unit 113Y. The exposure unit 111 irradiates laser lights 114Y, 114M, 114C, and 114K that are exposure lights corresponding to the image colors formed by the image formation units 106Y, 106M, 106C, and 106K, respectively.

When forming an image, the external surface of the photo conductor drum 109Y is uniformly charged by the electrification unit 110Y. Specifically, the exposure unit 111 irradiates laser light 114Y for an image that is yellow in color, and exposes the photo conductor drum 109Y that has been uniformly charged by the electrification unit 110Y. In this way, an electorstatic latent image is formed. The electrostatic latent image is made into a visible toner image by the development unit 112Y with a yellow toner. In this way, the toner image in yellow is formed on the photo conductor drum 109Y.

The imprint unit 115Y imprints the toner image in yellow formed on the photo conductor drum 109Y onto the paper 104 at a position (imprint position) where the photo conductor drum 109Y and the paper 104 on the conveyance belt 105 meet. In this way, the toner image in yellow is formed on the paper 104. The toner that remains on the photo conductor drum 109Y after imprinting the toner image in yellow is wiped away by a photo conductor cleaner (not illustrated); then, the photo conductor drum 109Y is discharged by the discharging unit 113Y so that it stands by for the next image formation.

Further, the paper 104 carrying the toner image in yellow imprinted by the image formation unit 106Y is conveyed to the following image formation unit 106M by the conveyance belt 105. With the image formation unit 106M, the toner image in magenta is formed on the photo conductor drum 109M by the same image formation process as the image formation unit 106Y. The toner image in magenta is superposed onto the toner image in yellow already formed on the paper 104.

The paper 104 is further conveyed to the following image formation units 106C and 106K. Then, the toner image in cyan is formed on the photo conductor drum 109C and the toner image in black is formed on the photo conductor drum 109K; and the toner images in cyan and black are, one after another, superposed onto the paper 104 by the same process. In this way, a full color image is formed on the paper 104. Then, the paper 104 carrying the full color image is removed from the conveyance belt 105, the full color image is fixed to the paper 104 by the fixing unit 116, and the paper 104 is delivered to the exterior of the image formation apparatus 100.

According to the image formation apparatus 100 structured as described above, the toner images in the different colors may not correctly overlap at a desired spot, and a position error may occur between the colors. Reasons for this include that there is an error in distances between axles of the photo conductor drums 109Y, 109M, 109C, and 109K, that there is a parallelism error between the photo conductor drums 109Y, 109M, 109C, and 109K, that there is an installation error of deflection mirrors (not illustrated) of the exposure units 111 for deflecting the laser light, and there is a timing error when writing the electrostatic latent images onto the photo conductor drums 109Y, 109M, 109C, and 109K. As causes of the position error of the colors, a skew, a resist error in the sub-scanning directions D2, a magnification error in the main scanning directions D1, and a resist error in the main scanning directions D1 are known. In order to compensate for the position error of the toner images in the different colors, the position error detection unit 117 is arranged on the downstream side of the image formation unit 106K, the position error detection unit 117 countering the conveyance belt 105.

The position error detection unit 117 includes three position error detection units 117*a*, 117*b*, and 117*c* (see FIG. 5) arranged to correspond to both ends and the center of the paper 104 in the main scanning directions D1, which main scanning directions D1 perpendicularly intersect the conveyance direction (the sub-scanning direction D2). The position error detection units 117*a*, 117*b*, and 117*c* detect marks 122*a*, 122*b*, and 122*c*, respectively, for position error compensation, which marks are formed on the conveyance belt 105 by the image formation apparatus 100 in order to compensate for the position error of the different colors.

The cleaner 118 wipes away the marks 122*a*, 122*b*, and 122*c* for position error compensation formed on the conveyance belt 105 by the image formation apparatus 100.

Figure 3:
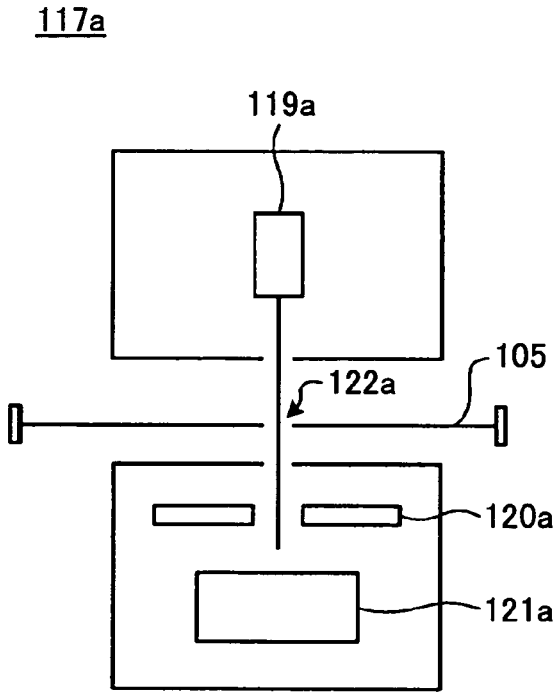
FIG. 3 is a schematic view of a position error detection unit of the image formation apparatus according to the embodiment of the present invention.

In the following, the position error detection unit 117 of the image formation apparatus 100 of the embodiment of the present invention is described with reference to FIGS. 3 through 7. FIG. 3 shows the outline structure of the position error detection unit 117*a* of the image formation apparatus 100 according to the embodiment of the present invention. The position error detection units 117*a*, 117*b*, and 117*c* (FIG. 5) are structured the same. Accordingly, the position error detection unit 117*a* is described here, and descriptions are not repeated for the position error detection units 117*b* and 117*c*. The position error detection unit 117*a* includes a luminous source 119*a*, a slit 120*a*, and an optical receiving unit 121*a*. A light emitted by the luminous source 119*a* is received by the optical receiving unit 121*a* through the slit 120*a*.

Figure 4:
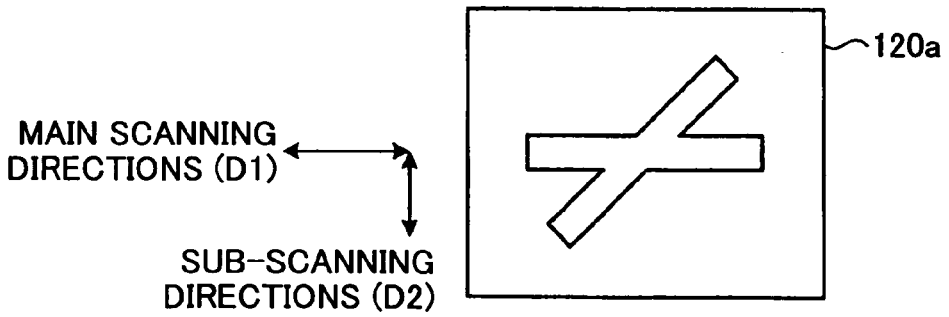
FIG. 4 is an enlarged view of a slit of the position error detection unit of the image formation apparatus according to the embodiment of the present invention.

FIG. 4 is an enlarged view of the slit 120*a* of the position error detection unit 117*a* of the image formation apparatus 100 according to the embodiment of the present invention. As shown in FIG. 4, the slit 120*a* includes an opening parallel to the main scanning direction D1, and another opening that diagonally crosses the parallel opening.

Figure 5:
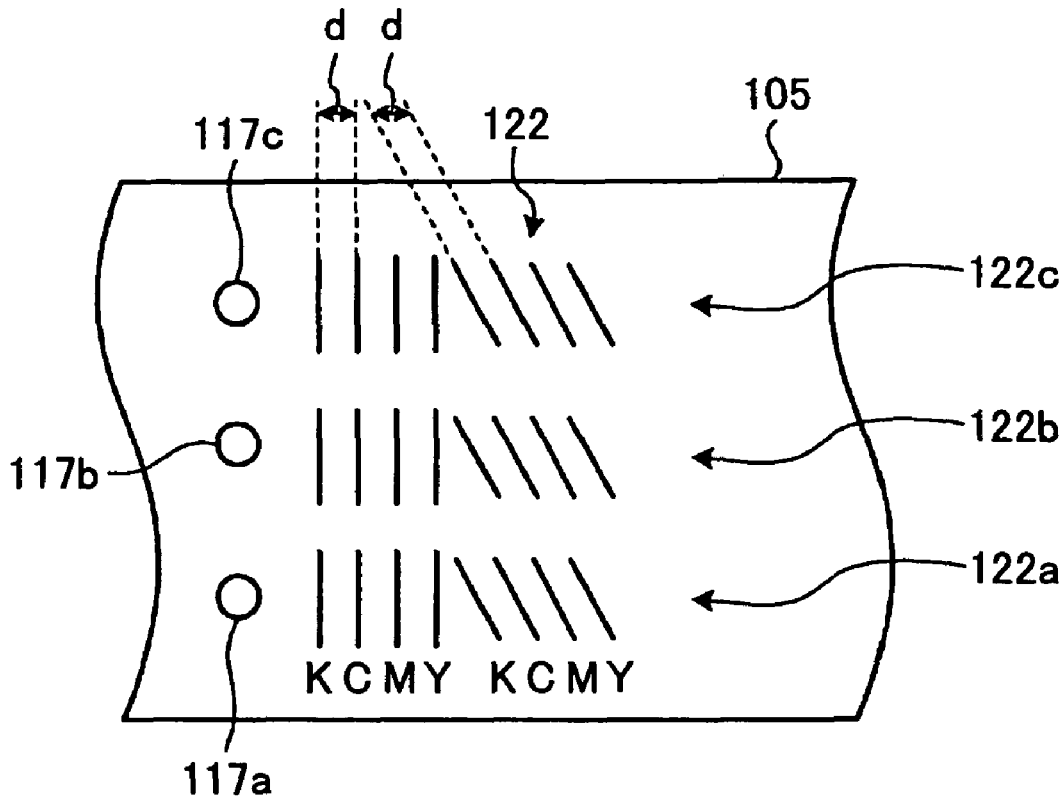
FIG. 5 is an enlarged view of marks for position error compensation formed by the image formation apparatus according to the embodiment of the present invention.

FIG. 5 is an enlarged view of the marks 122*a*, 122*b*, and 122*c* (collectively referred to as the marks 122) for position error compensation formed by the image formation apparatus 100 according to the embodiment of the present invention. Each of the marks 122*a*, 122*b*, and 122*c* for position error compensation includes four parallel lines (lines parallel in the main scanning direction D1), one each for black K, cyan C, magenta M, and yellow Y; and four inclined lines that are inclined to the parallel lines, one each for black K, cyan C, magenta M, and yellow Y. Adjacent ones of the parallel lines are spaced at a predetermined interval d, and adjacent ones of the inclined lines (slashes) are spaced at the predetermined interval d. When each line comes to the opening of the slit 120*a* of the position error detection unit 117*a*, a detecting signal that gives either a peak or a valley is generated. In this way, the position of each line, which constitutes the mark 122*a* for position error compensation, is correctly acquired.

Figure 6:
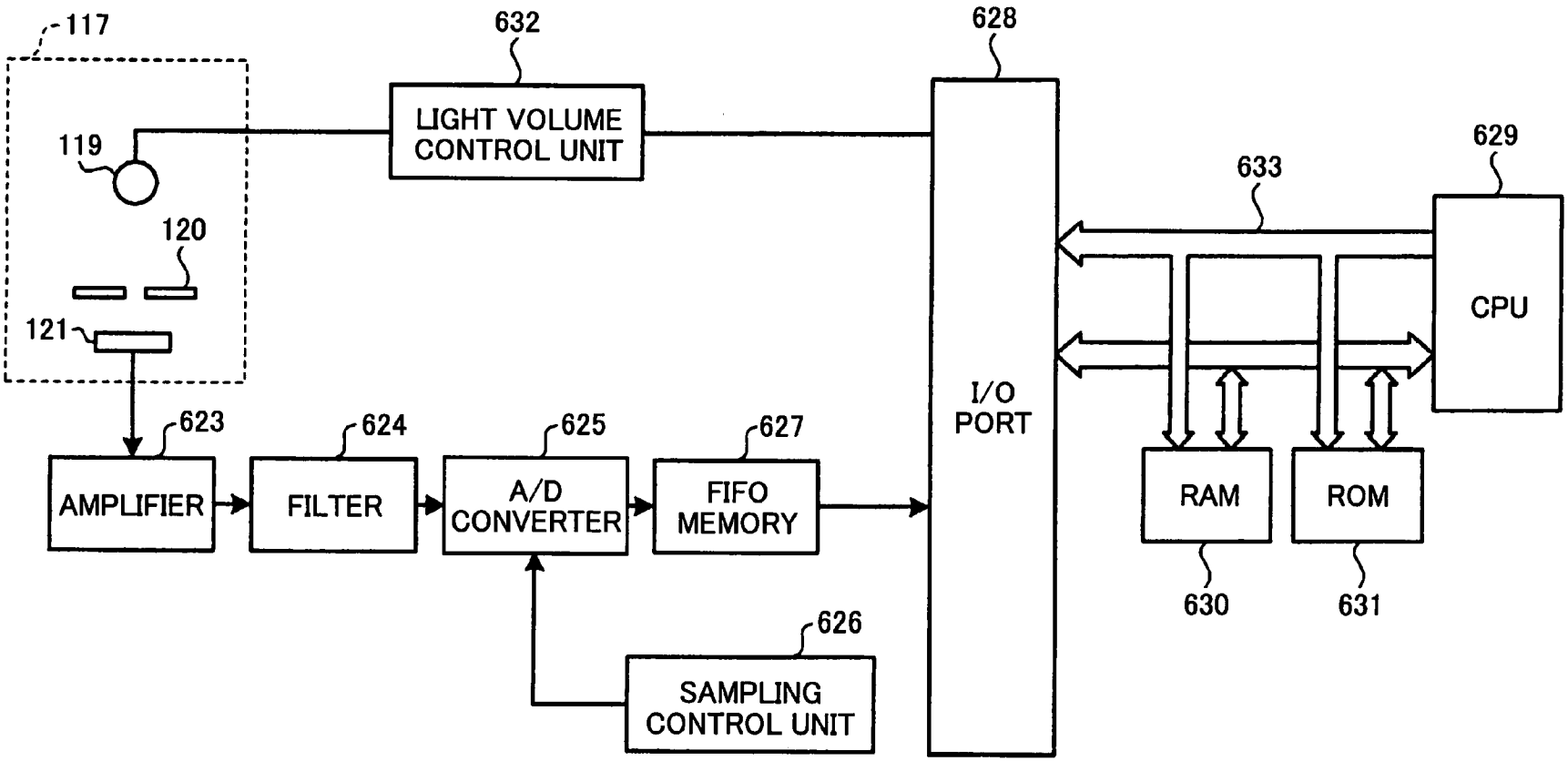
FIG. 6 is a block diagram of the hardware configuration of the image formation apparatus according to the embodiment of the present invention.

Next, operations of the position error detection unit 117 of the image formation apparatus 100 according to the embodiment of the present invention are described with reference to FIG. 6 that shows the hardware configuration of the image formation apparatus 100 according to the embodiment of the present invention. The image formation apparatus 100 includes the position error detection unit 117, an amplifier 623, a filter 624, an A/D converter 625, a sampling control unit 626, a FIFO memory 627, an I/O Port 628, a CPU 629, a RAM 630, a ROM 631, and a light volume control unit 632.

A signal provided by the optical receiving unit 121 of the position error detection unit 117 is amplified by the amplifier 623. The filter 624 passes only the signal at the time of detecting the line that constitutes the marks 122 for position error compensation out of signals provided by the optical receiving unit 121. The signal filtered by the filter 624, which signal is analog, is converted into a digital signal by the A/D converter 625. The sampling control unit 626 controls data sampling of the analog signal, and the sampled data are stored in the FIFO memory 627. After detection of a set of the marks 122*a*, 122*b*, and 122*c* for position error compensation is completed, the stored data are loaded into the CPU 629 and the RAM 630 through a data bus 633 and the I/O Port 628.

The CPU 629 generates the marks 122 for position error compensation, which marks 122 are for compensating for the position error of the different colors generated in the image formation process. Further, the CPU 629 detects the position of each line of the marks 122 for position error compensation by the position error detection unit 117. Further, the CPU 629 counts the number of position detections of the line detected by the position error detection unit 117. Then, the CPU 629 calculates the position error compensation value for compensating for the position error of the different colors, the position errors being due to the skew, the resist error in the sub-scanning direction D2, the magnification error in the main scanning direction D1, the resist error in the main scanning direction D1, etc., by performing a predetermined calculation process based on the detection result by the position error detection unit 117. Then, the CPU 629 performs position error compensation based on a result of the calculation process.

The skew is compensated for by adjusting, for example, the inclination of the exposure unit 111, and the inclination of the deviation mirror of the exposure unit 111 with an actuator. Further, the resist error in the sub-scanning direction D2 is compensated for by adjusting the writing start timing in the sub-scanning direction D2, and a face phase angle of a polygon mirror. The magnification error in the main scanning direction D1 is compensated for, for example, by adjusting a writing frequency. The resist error in the main scanning direction D1 is compensated for by adjusting the start timing in the main scanning direction D1.

Information about the position (position information) of the line that constitutes the marks 122 for position error compensation detected by the position error detection unit 117 is stored in the RAM 630. Further, the number of position detections (detected positions) of the line that constitutes the marks 122 for position error compensation detected by the position error detection unit 117 is stored in the RAM 630. Further, various programs for controlling the image formation process, in addition to the program for calculating the compensation value for the position error compensation, are stored in the ROM 631.

Further, the CPU 629 monitors the signal provided by the optical receiving unit 121 at suitable timings, and controls the amount of luminescence of the luminous source 119 by the light volume control unit 632 such that the marks 122 for position error compensation can be detected even if there are degradation of the conveyance belt 105, degradation of the luminous source 119, and the like. The amount of luminescence of the luminous source 119 is adjusted so that a predetermined level of the signal provided to the optical receiving unit 121 is maintained constant. In this way, the CPU 629 and the ROM 631 function as a control unit to control operations of the image formation apparatus 100.

Although FIG. 5 shows one set of the marks 122*a*, 122*b*, and 122*c* for position error compensation, this is the minimum required in order to perform the position error compensation of the different colors. In order to compensate for a fluctuation error due to a rotation fluctuation of the photo conductor drum 109 and the conveyance belt 105, two or more sets of the marks for position error compensation are formed in a round period (one full rotational cycle) of the photo conductor drum 109. Then, the sets of the marks for position error compensation are detected by the position error detection unit 117, and the position error compensation value is calculated based on sets of the marks for position error compensation that are correctly detected. The position error compensation process is performed based on an average position error compensation value that is an average of the calculated position error compensation values.

Figure 7:
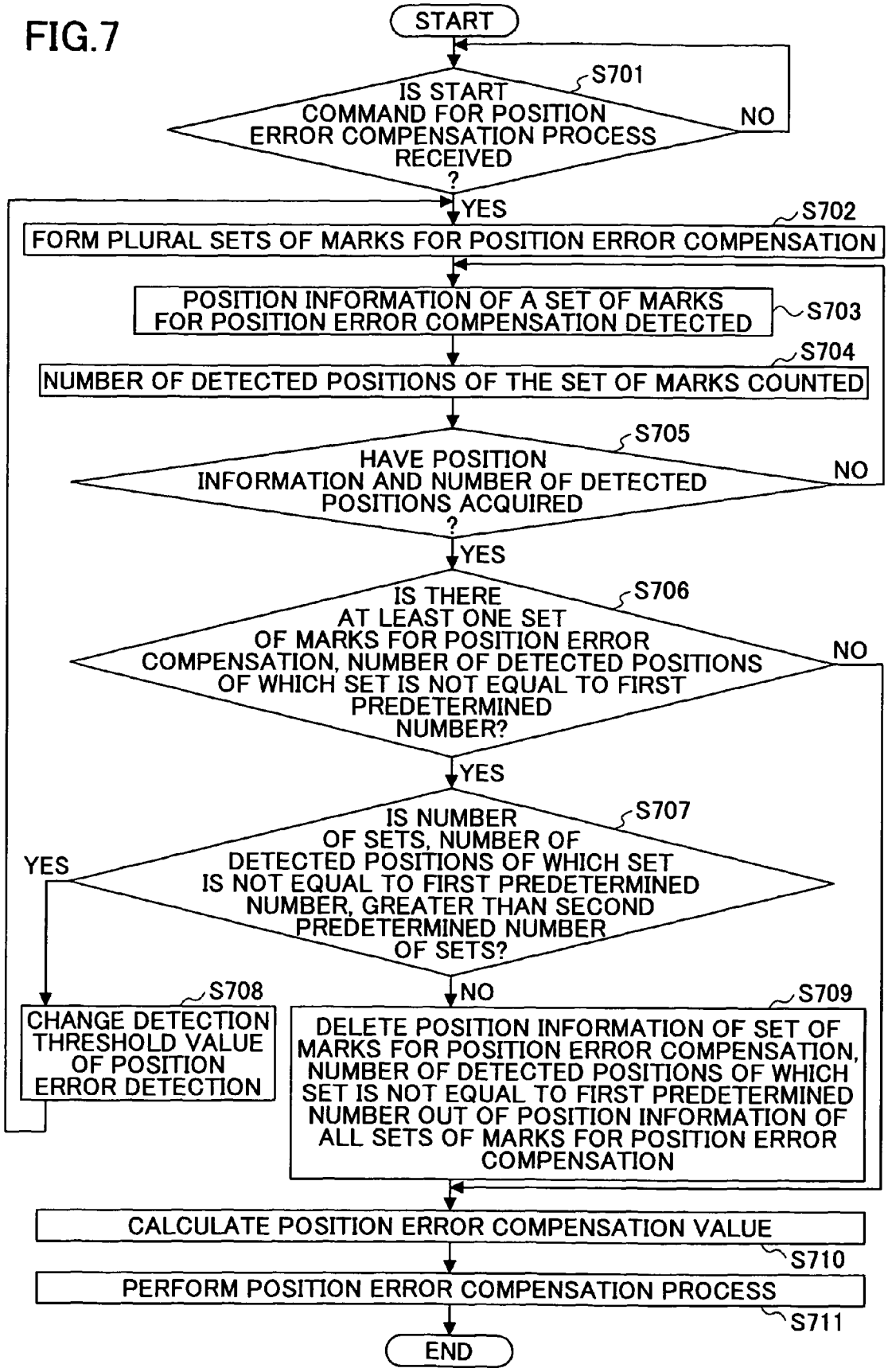
FIG. 7 is a flowchart of a position error compensation process of the image formation apparatus according to the embodiment of the present invention.

FIG. 7 is a flowchart showing the position error compensation process of each color of the image formation apparatus 100 according to the embodiment of the present invention.

With reference to FIG. 7, first, it is determined whether the CPU 629 has received a start command for the position error compensation process (step S701). The start command of position error compensation process is generated, for example, by a user operating an operations panel (not illustrated).

At step S701, if the start command for the position error compensation process is received (Yes at step S701), the CPU 629 forms two or more sets of the marks for position error compensation for compensating for the position error of the different colors (step S702). Formation information of the marks 122 for position error compensation is beforehand stored in the ROM 631, and the marks 122*a*, 122*b*, and 122*c* for position error compensation that constitute a set of the marks 122 for position error compensation are configured by four parallel lines and four slashes (inclined lines) at the predetermined interval d as shown in FIG. 5.

Next, the CPU 629 detects the position information of a set of the marks for position error compensation (step S703). The position error detection units 117*a*, 117*b*, and 117*c* detect the position information of the marks 122*a*, 122*b*, and 122*c*, respectively, for position error compensation that constitute the set of marks 122 for position error compensation. Here, the detected position information is stored in the RAM 630 through the I/O Port 628.

Further, in step S704 the CPU 629 counts the number of position detections (detected positions) of a set of the marks 122 for position error compensation detected at step S703. The number of position detections is the number of the lines detected by the position detection unit 117, which lines constitute the marks 122 for position error compensation of each set. Each of the marks 122*a*, 122*b*, and 122*c* for position error compensation that constitute a set of the marks 122 for position error compensation is constituted by a total of eight lines, namely, four parallel lines and four slashed lines (inclined lines). For this reason, when all the lines that constitute the set of the marks 122*a*, 122*b*, and 122*c* for position error compensation are correctly detected by the position error detection unit 117*a*, 117*b*, and 117*c*, respectively, the total number of position detections (detected positions) is 8×3=24. Hereafter, this number represents the first predetermined number. In addition, the number of detected positions is related to (associated with) the position information detected at step S703, and is stored in the RAM 630.

Then, the CPU 629 determines whether it has received the position information and the number of detected positions of the marks 122 for position error compensation of the last set (step S705). At step S705, if the marks 122 for position error compensation of the last set have not been detected (No at step S705), the process returns to step S703 and the process is repeated.

Otherwise, i.e., if the position information and the number of detected positions of the marks 122 for position error compensation of the last set are detected (Yes at step S705), the CPU 629 determines (step S706) whether there is one or more sets of the marks 122 for position error compensation, the number of detected positions of which set is not equal to the first predetermined number, i.e., 24 according to the embodiment, out of all the sets of the marks 122 for position error compensation detected at steps S703 through S705. Specifically, the CPU 629 determines whether there is one or more sets of the marks 122 for position error compensation, the number of detected positions of which set is not equal to the first predetermined number out of all the sets of the marks 122 for position error compensation stored in the RAM 630.

If there is no set of the marks 122 for position error compensation, the number of detected positions of which set is not equal to the first predetermined number (No at step S706), in other words, if all the lines that constitute the marks 122 for position error compensation of all the sets have been correctly detected, the process proceeds to step S710 where the CPU 629 calculates a position error compensation value based on the position information on all the marks 122 for position error compensation stored in the RAM 630.

Otherwise, if there is one or more sets of the marks 122 for position error compensation, the number of detected positions of which set is not equal to the first predetermined number (Yes at step S706), the CPU 629 determines whether the number of such sets is greater than the second predetermined number (step S707). The second predetermined number is greater than 1 and less than the total number of the sets of the marks 122 for position error compensation, and is beforehand stored in the ROM 631.

If the determination at step S707 is affirmative, i.e., if the number of sets of the marks 122 for position error compensation, the number of detected positions of which set is not equal to the first predetermined number, is greater than the second predetermined number (Yes at step S707), the CPU 629 changes a detection threshold value of the position error detection unit 117 (step S708). Then, the process returns to step S702 for repeating. In this case, in order to shorten time taken by the position error compensation process, the number of sets of the marks 122 for position error compensation formed at step S702 is made smaller than the last time.

Otherwise, i.e., if the determination at step S707 is negative, that is, if the number of sets of the marks 122 for position error compensation, the number of detected positions of which sets is not equal to the first predetermined number, is not greater than the second predetermined number (No at step S707), the CPU 629 deletes the position information of the marks 122 for position error compensation, the number of detected positions of which set is not equal to the first predetermined number out of the position information of all the sets of marks for position error compensation stored in the RAM 630 (step S709). Then, the CPU 629 calculates the position error compensation value based on the position information of the marks 122 for position error compensation, the number of detected positions of which set is equal to the first predetermined number (step S710). Then, the CPU 629 performs the position error compensation process (step S711) based on the position error compensation value calculated at step S710, and ends the series of the process.

In addition, the embodiment of the present invention as described above is an example of a suitable implementation of the present invention; variations and modifications may be made without departing from the scope of the present invention. For example, although the marks 122 for position error compensation are formed on the conveyance belt 105 according to the embodiment, they can be formed on a middle imprinting belt, for example.

Further, although the slit 120 is used as the position error detection unit 117 according to the embodiment, a configuration dispensing with the slit 120 is possible as long as the marks 122 for position error compensation can be detected. Further, although each of the marks 122*a*, 122*b*, and 122*c* for position error compensation includes four parallel lines and four slashes according to the embodiment, the mark for position error compensation can take other shapes such as a mountain-like shape (^) as long as a position error can be detected.

As described above, according to the image formation apparatus, the image formation method, the image formation program, and the computer readable recording medium of the present invention, two or more sets of marks for position error compensation formed on the conveyance belt are detected by the position error detection unit and the position error of the different colors generated when forming the image is compensated for. Further, the position error compensation value is calculated based on the marks for position error compensation correctly detected by the position error detection unit out of all the sets of marks for position error compensation. Further, when the number of the marks for position error compensation correctly detected by the position error detection unit is less than a predetermined number, the marks for position error compensation are formed and detected again. In this instance, the number of sets of the marks for position error compensation formed again is made less than the last time so that the time required by the position error compensation process is shortened. In this way, the position error of the different colors can be rectified in a short time, and a highly precise image formation process can be performed.

In addition, the image formation method according to the embodiment can be realized by executing the program on a computer such as a personal computer and a workstation. The program is stored in the computer-readable recording medium such as a hard disk, a flexible disk, a CD-ROM, a MO, and a DVD, and is executed by the computer reading the program from the recording medium. Further, the program may be acquired through a transmission link such as the Internet.

AVAILABILITY ON INDUSTRY

As described above, the image formation apparatus, the image formation method, the image formation program, and the computer-readable recording medium are useful to digital copiers that have functions such as copying, facsimile, and printing, and are especially suitable for copying machines that read a manuscript and deliver printed outputs.

Further, the present invention is not limited to these embodiments, but variations and modifications may be made without departing from the scope of the present invention.

The present application is based on Japanese Priority Application No. 2006-020946 filed on Jan. 30, 2006 with the Japanese Patent Office, the entire contents of which are hereby incorporated by reference.

What is claimed is:

1. An image formation apparatus wherein two or more toner images in different colors are superposed on an endless conveyance belt to form a color image for imprinting, and the color image for imprinting is imprinted to an imprinting medium, comprising:

an image formation unit for forming a plurality of sets of marks for position error compensation for compensating for a position error of the different colors, which position error is generated when forming the color image on the conveyance belt;

a detection unit for detecting position information about positions of the sets of marks for position error compensation formed on the conveyance belt by the image formation unit;

a control unit for performing a position error compensation process based on the position information detected by the detection unit; and a storage unit for storing the position information of the sets of the marks for the position error compensation detected by the detection unit, wherein the control unit determines the number of detected positions of the marks for position error compensation from the position information for each of the sets, and performs the position error compensation process based on the position information of the marks for position error compensation of a set, the number of detected positions of which set is equal to a first predetermined number out of all the sets of the marks for position error compensation, and the control unit deletes a set of the marks for position error compensation, the number of detected positions of which set is not equal to the first predetermined number, and performs the position error compensation process based on the position information of a set of the marks for position error compensation, the number of detected positions of which set is equal to the first predetermined number.

2. The image formation apparatus as claimed in claim 1, wherein, if the number of sets, the number of detected positions of the marks for position error compensation of each of which sets is not equal to the first predetermined number, is greater than a second predetermined number, the control unit changes a detection threshold value of the detection unit, controls the image formation unit to form a plurality of the sets of the marks for position error compensation again, and carries out again the position error compensation process.

3. The image formation apparatus as claimed in claim 2, wherein if the number of the sets of the marks for position error compensation, the number of detected positions of each of which sets is not equal to the first predetermined number, is greater than the second predetermined number, the control unit controls the image formation unit such that a smaller number of sets of the marks for position error compensation are formed than the last time, and carries out again the position error compensation process.

4. The image formation apparatus as claimed in claim 1, wherein the control unit causes a plurality of detection units to detect the position information of the sets of the marks for position error compensation, calculates compensation values for performing the position error compensation process based on results of the detection of the corresponding sets, averages the compensation values calculated, and carries out the position error compensation process based on the average compensation value.

5. An image formation method wherein two or more toner images in different colors are superposed on an endless conveyance belt to form a color image for imprinting, and the color image for imprinting is imprinted to an imprinting medium, the method comprising:

an image formation process of forming a plurality of sets of marks for position error compensation for compensating for a position error of the different colors, which position error is generated when forming the color image on the conveyance belt;

a detection process of detecting position information about positions of the sets of marks for position error compensation formed on the conveyance belt by the image formation process;

a control process of performing a position error compensation process based on the position information detected by the detection process; and a storage process of storing the position information of the sets of the marks for the position error compensation detected by the detection process, wherein the control process determines the number of detected positions of the marks for position error compensation from the position information for each of the sets, and performs the position error compensation process based on the position information of the marks for position error compensation of a set, the number of detected positions of which set is equal to a first predetermined number out of all the sets of the marks for position error compensation, and the control process deletes a set of the marks for position error compensation, the number of detected positions of which set is not equal to the first predetermined number, and performs the position error compensation process based on the position information of a set of the marks for position error compensation, the number of detected positions of which set is equal to the first predetermined number.

6. The image formation method as claimed in claim 5, wherein, if the number of sets, the number of detected positions of the marks for position error compensation of each of which sets is not equal to the first predetermined number, is greater than a second predetermined number, the control process changes a detection threshold value of the detection process, controls the image formation process to form a plurality of the sets of the marks for position error compensation again, and carries out again the position error compensation process.

7. The image formation method as claimed in claim 6, wherein if the number of the sets of the marks for position error compensation, the number of detected positions of each of which sets is not equal to the first predetermined number, is greater than the second predetermined number, the control process controls the image formation process such that a smaller number of sets of the marks for position error compensation are formed than the last time, and carries out again the position error compensation process.

8. The image formation method as claimed in claim 5, wherein the control process causes the detection process to detect the position information of the sets of the marks for position error compensation, calculates compensation values for performing the position error compensation process based on results of the detection of the corresponding sets, averages the compensation values calculated, and carries out the position error compensation process based on the average compensation value.

9. A non-transitory computer-readable recording medium that stores an image formation program which, when executed on a computer device, cause the computer device to execute the formation method as claimed in claim 5.

* * * * *